US012655619B2

(12) United States Patent
Huang et al.

(10) Patent No.: US 12,655,619 B2
(45) Date of Patent: Jun. 16, 2026

(54) QUICK INSTALLATION STRUCTURE FOR A BODY CORE WITH ROTATABLE FLEXIBLE PIPE

(71) Applicant: CLEMENT INC., Flushing, NY (US)

(72) Inventors: Lengjie Huang, Wuhan (CN); Chunhua Wang, Wuhan (CN); Changzheng Ni, Wuhan (CN); Yongqiang Yan, Shanghai (CN)

(73) Assignee: CLEMENT INC., Flushing, NY (US)

( * ) Notice: Subject to any disclaimer, the term of this patent is extended or adjusted under 35 U.S.C. 154(b) by 109 days.

(21) Appl. No.: 18/643,373

(22) Filed: Apr. 23, 2024

(65) Prior Publication Data

US 2025/0327282 A1 Oct. 23, 2025

(51) Int. Cl.
*E03C 1/04* (2006.01)

(52) U.S. Cl.
CPC .... *E03C 1/0403* (2013.01); *E03C 2001/0415* (2013.01)

(58) Field of Classification Search
CPC ..... E03C 1/0403; E03C 2001/0414; E03C 2001/0415; E03C 2001/0417; F16L 19/04; F16L 19/043
See application file for complete search history.

(56) References Cited

U.S. PATENT DOCUMENTS

| | | | | |
|---|---|---|---|---|
| 6,757,921 | B2 * | 7/2004 | Esche | E03C 1/04 4/677 |
| 7,533,683 | B2 * | 5/2009 | Ortega | F16K 19/006 137/454.6 |
| 9,334,634 | B2 * | 5/2016 | Bares | F16L 37/00 |
| 10,234,049 | B1 * | 3/2019 | He | F16K 31/605 |
| 10,450,729 | B2 * | 10/2019 | Chang | F16K 11/085 |

* cited by examiner

*Primary Examiner* — Erin Deery

(57) ABSTRACT

A quick installation structure for a body core with rotatable flexible pipe water pipes includes a body core and at least two water pipes connected thereto. The water pipes include snap grooves and sealing rings. The body core includes at least two pipe holes for water pipes and a gasket insertion groove perpendicular to and communicates with the pipe holes for a gasket Another end of the water pipe is alternatively connected to a nut which includes a smooth section and an end surface beside the smooth section, the water pipes pass through the nut and are restricted by the end surface, the snap groove passes through the nut and is exposed out of the nut, an snap ring is inserted into the snap groove, so that the water pipes and the nut are rotatably connected to the body core without detachment.

10 Claims, 14 Drawing Sheets

QUICK INSTALLATION STRUCTURE FOR A BODY CORE WITH ROTATABLE FLEXIBLE PIPE

TECHNICAL FIELD

The present disclosure relates to the field of sanitary ware, in particular to a quick installation structure for a body core with rotatable flexible pipe.

BACKGROUND

At present, the structure for assembling and connecting the flexible pipe with the faucet body or the body core in the faucet is basically screw-threaded. This structure has drawbacks such as low yield and affecting efficiency. Moreover, the nuts of this structure are not flexible enough which causes low installation efficiency at the end terminal, and it may be unintentionally broken up, thus this structure is very unfriendly to the installation.

SUMMARY

The present disclosure provides a quick installation structure for a body core with rotatable flexible pipe which can effectively solve the above problems.

The present disclosure is implemented as follows.

A Quick Installation Structure for a Body Core with Rotatable Flexible Pipe, Including:

water pipes, wherein the water pipes include snap grooves and sealing rings that are sequentially provided at one end and/or both ends of the water pipes, and the snap grooves are provided at a side proximal to the middle of the water pipes;

the body core includes at least two pipe holes and a gasket insertion groove perpendicular to and communicates with the pipe holes, the gasket insertion groove corresponds to the snap grooves, and the water pipes are inserted into the pipe holes, a gasket is inserted into the gasket insertion groove and is engaged with the snap grooves; and/or a nut, wherein the nut includes a smooth section and an end surface located next to the smooth section, the water pipes pass through the nut and are restricted by the end surface, one of the snap grooves passes through the nut and is exposed from an upper end surface of the nut, an snap ring is inserted into the snap groove, so that the water pipes and the nut are rotatably connected to the body core without unintentional detachment.

As a further improvement, a bottom end surface of the body core is provided with a pin groove extending upward, and the gasket is provided with a pin hole corresponding to the pin groove, and a pin is inserted into the pin groove and the pin passes through the pin hole to be engaged with the gasket.

As a further improvement, the water pipes include two first water pipes and a second water pipe, both ends of the first water pipes are respectively provided with a first snap groove and a third snap groove, and first sealing grooves are respectively provided at a side of the first snap groove and the third snap groove away from the middle of the first water pipes; an end of the second water pipe is provided with a second snap groove and a second sealing groove, and the second sealing groove is located at a side of a middle part of the second water pipe, each of the first sealing grooves and the second sealing groove is provided with one of the sealing rings.

As a further improvement, the bottom end surface of the body core is provided with two first water pipe holes and a second water pipe hole extending upward, the two first water pipe holes are arranged side by side, and the second water pipe hole is provided between the two first water pipe holes and is staggered with the two first water pipe holes; the two first water pipes and the second water pipe are respectively inserted into the first water pipe holes and the second water pipe hole, the sealing rings on the first water pipes and the second water pipe are sealingly matched with side wall surfaces of the first water pipe holes and the second water pipe hole.

As a further improvement, a back surface of the body core is transversely provided with a gasket insertion groove extending toward a front end surface of the body core, and the gasket insertion groove communicates with the first water pipe holes and the second water pipe hole, the gasket is inserted into the gasket insertion groove and is engaged with the first snap groove and the second snap groove.

As a further improvement, the front end surface of the body core is provided with two first water passage holes, a second water passage hole, and two positioning holes at intervals, the two first water passage holes are arranged side by side, and the two positioning holes are arranged side by side and are arranged away from the first water passage holes, and the second water passage hole is provided in a middle position surrounded by the two first water passage holes and the two positioning holes, the first water passage holes communicate with the first water pipe holes through a first water passage, the second water passage hole communicates with the second water pipe hole through a second water passage.

As a further improvement, the gasket includes two first pipe snap grooves and a second pipe snap groove, the two first pipe snap grooves are arranged side by side, and the second pipe snap groove is provided on a side of the first pipe snap grooves and is placed in the middle, and the pin hole is located on another side of the first pipe snap groove and corresponds to the second pipe snap groove at interval; the first pipe snap groove and the second pipe snap groove are each provided with an opening, and the openings are arranged toward a side away from the pin hole.

As a further improvement, the pin includes a pin head and a pin body provided at an end of the pin head, the pin body is provided with a recess at an end away from the pin head, and the recess is provided with a step at the end away from the pin head, the pin is inserted into the pin groove and passes through the pin hole to be engaged with the pin hole, the recess is located in the pin hole, and the step is restricted to a bottom end of the pin groove.

As a further improvement, an inner wall of the nut is provided with the smooth section and a threaded section, and the end surface is provided between the smooth section and the threaded section; the first water pipes are each provided with a limiting shoulder at a side where the third snap groove is located, and the limiting shoulder is located at a side away from the middle of the first water pipe; when the nut is connected to the first water pipe, the limiting shoulder is limited to the end surface, the sealing ring is sealingly matched with the smooth section, and the third snap groove passes through the nut and is exposed from an upper end surface of the nut, and the third snap groove is engaged with the snap ring.

As a further improvement, the snap ring has an opening, and both sides of the opening are respectively provided with an engagement point.

The present disclosure has the following advantages.

1. The water pipes are directly inserted into the body core, and then the water pipes are fixed on the body core by a gasket. The gasket locks the water pipes so that the water pipes will not come off. The assembly of this structure is quick and easy to operate.
2. With the collaboration of the pin and the gasket, the gasket can lock the water pipes while ensuring that the gasket will not come off from the body core, and its connection structure is stable.
3. By setting sealing rings on the water pipes and making the sealing rings sealingly matched with the body core, the water pipes are allowed to rotate freely 360°, and its installation is quick and convenient without any broken up.
4. The nut is engaged on the water pipe through the snap ring, so that the nut will not come off, the water pipe can be freely assembled with external parts. Compared with the traditional assembly method, this structure can greatly improve work efficiency and save costs.

BRIEF DESCRIPTION OF THE DRAWINGS

In order to explain the technical solutions of the implementations of the present disclosure much clearly, the drawings that would be used in describing the implementations will be briefly introduced below. It should be understood that the drawings illustrated below merely includes some of the embodiments of the present disclosure and should not be considered as limiting the scope of the present disclosure. For those of ordinary skill in the art, other drawings may be derived based on these drawings without creative effort.

Figure 1:
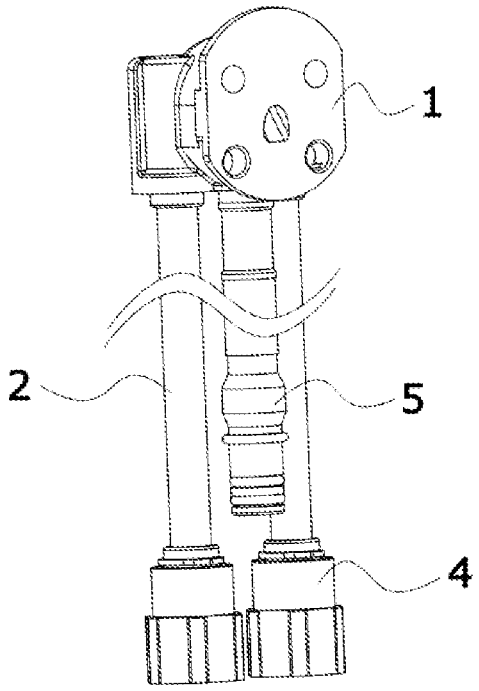
FIG. 1 is an isometric view of an embodiment of the present disclosure.
Figure 2:
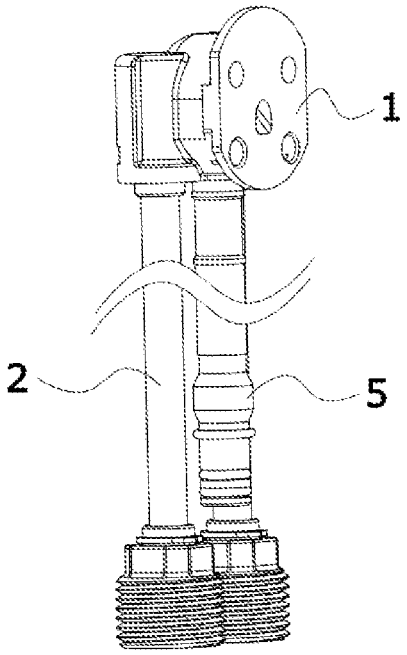
FIG. 2 is an isometric view of another embodiment of the present disclosure.
Figure 3:
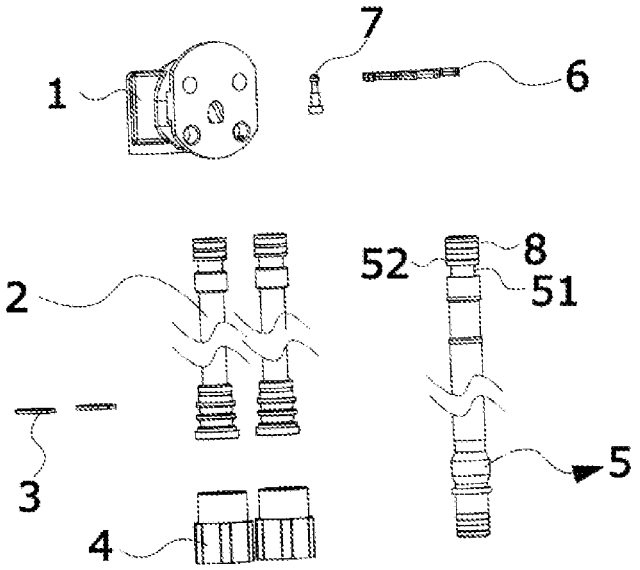
FIG. 3 is a first exploded view of an embodiment of the present disclosure.

The Reference Numerals in the Drawings are Listed Below:

1—body core; 11—pin groove; 12—gasket insertion groove; 13—first water pipe hole; 14—first water passage; 141—first water passage hole; 15—positioning hole; 16—second water passage; 161—second water passage hole; 17—second water pipe hole; 18—bottom end surface; 180—front end surface; 181—back surface;

2—first water pipe; 21—first snap groove; 22—first sealing groove; 23—third snap groove; 24—limiting shoulder;

3—snap ring; 31—engagement point; 32—opening;

4—nut; 41—end surface; 42—smooth section; 43—threaded section; 44—upper end surface;

5—second water pipe; 51—second snap groove; 52—second sealing groove;

6—gasket; 61—pin hole; 62—first pipe snap groove; 621—opening; 63—second pipe snap groove; 631—opening;

7—pin; 71—pin head; 72—pin body; 721—recess; 722—step;

8—sealing ring;

9—faucet; 91—faucet body; 92—water spout; 93—valve core.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a characteristic that is referred to by "first"

and "second" may include, expressly or implicitly, one or more of the characteristics. In the description of the present disclosure, the term "plural/plurality" means two or more, unless otherwise explicitly defined.

Referring to FIGS. 1-27, a quick installation structure for a body core with rotatable flexible pipe is installed on the faucet body 91. The quick installation structure for a body core with rotatable flexible pipe includes a body core 1, and two first water pipes 2 and a second water pipe 5 provided on the body core 1. The first water pipes 2 are set as water inlet pipes, the second water pipe 5 is set as a water outlet pipe, the water flow enters from the first water pipes 2, then passes through the body core 1 and the valve core 93 provided on the body core 1 to flow out from the second water pipe 5 and flow to the water spout 92 of the faucet 9.

In a conventional structure, the first water pipes 2 and the second water pipe 5 are connected to the body core 1 by a structure which is fixed and does not allow rotation. Such structure is usually a thread connected structure. In this embodiment, the structure for connecting the first water pipes 2 and the second water pipe 5 to the body core 1 allows rotation.

In order to make the first water pipes 2 and the second water pipe 5 rotatable about the body core 1, the first water pipes 2 and the second water pipe 5 are respectively provided with a first snap groove 21 and a second snap groove 51 at an end proximal to the body core 1. The first snap groove 21 and the second snap groove 51 are annular. The first snap groove 21 and the second snap groove 51 are both provided with at least one sealing groove 52, 22 in an annular shape at the end proximal to the body core 1, and sealing rings 8 are respectively provided in the sealing grooves 52, 22. The bottom end surface 18 of the body core 1 is provided with three mutually spaced pipe holes 13 and 17 extending upward. Two first water pipes 2 and one second water pipe 5 are inserted into the pipe holes 13 and 17 and are sealingly matched with the sidewall of the pipe holes 13, 17 by the sealing rings 8. The back surface 181 of the body core 1 is transversely provided with a gasket insertion groove 12 facing toward its front end surface 180. The gasket insertion groove 12 communicates with the pipe holes 13, 17. When the first water pipes 2 and the second water pipe 5 are inserted into the pipe holes 13, 17 and kept stable, the gasket insertion groove 12 is arranged corresponding to the first snap groove 21 and the second snap groove 51 and has the same height with the first snap groove 21 and the second snap groove 51. A gasket 6 is inserted from the gasket insertion groove 12 toward the front end surface 180 of the body core 1, and the gasket 6 can simultaneously clamp the first water pipes 2 and the second water pipe 2, so that the first water pipes 2 and the second water pipe 5 cannot come off from the pipe holes 13, 17, and the first water pipes 2 and the second water pipe 5 are allowed to rotate in the pipe holes 13, 17. In this embodiment, the three pipe holes 13 and 17 include two first water pipe holes 13 and one second water pipe hole 17. The two first water pipe holes 13 are arranged side by side, and the second water pipe hole 17 is provided between the two first water pipe holes 13 and is staggered with the two first water pipe holes 13.

Figure 16:
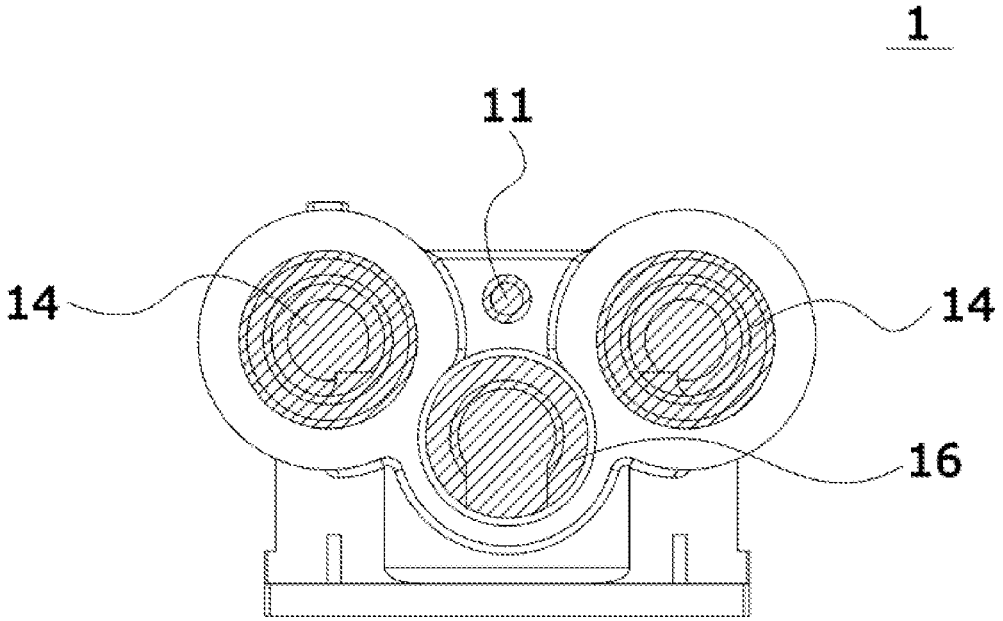
FIG. 16 is a cross-sectional view from a bottom view of the embodiment of the present disclosure.
Figure 17:
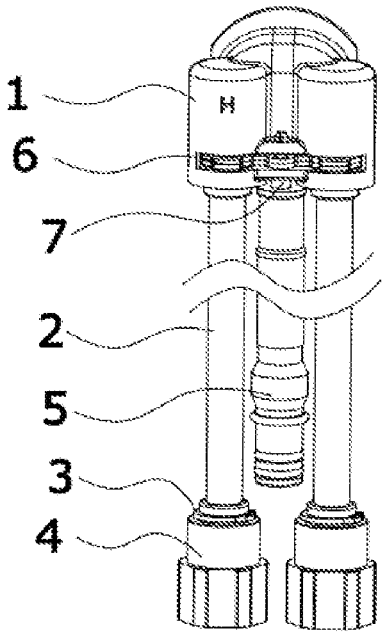
FIG. 17 is a diagram showing a first state of the embodiment of the present disclosure.
Figure 18:
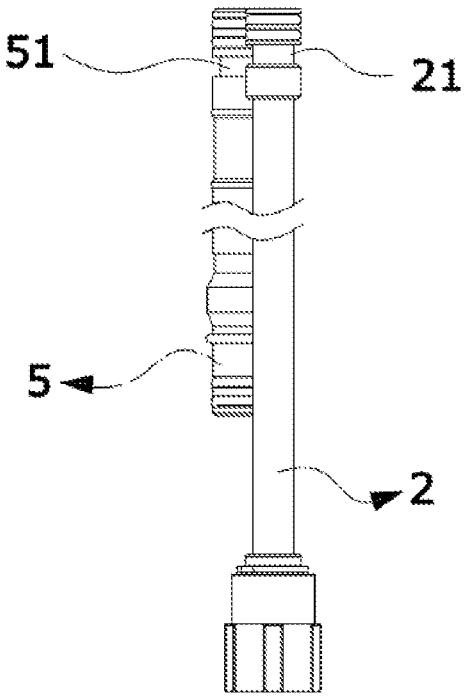
FIG. 18 is a diagram showing a second state of the embodiment of the present disclosure.

In order to ensure that the gasket 6 cannot fall off from the gasket insertion groove 12, as shown in FIG. 16, a pin groove 11 is provided on the bottom end surface 18 of the body core 1 extending upward, and the pin groove 11 is located between the two first water pipe holes 13 and located on a side of the second water pipe hole 17. The pin 7 is inserted into the pin groove 11 from a side of the bottom end surface 18 of the body core 1 to get engaged with the gasket 6 so that the gasket 6 cannot fall off.

Figure 4:
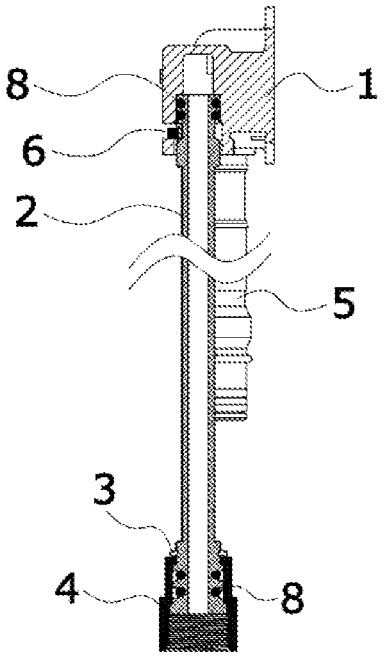
FIG. 4 is a first cross-sectional view of the embodiment of the present disclosure.
Figure 5:
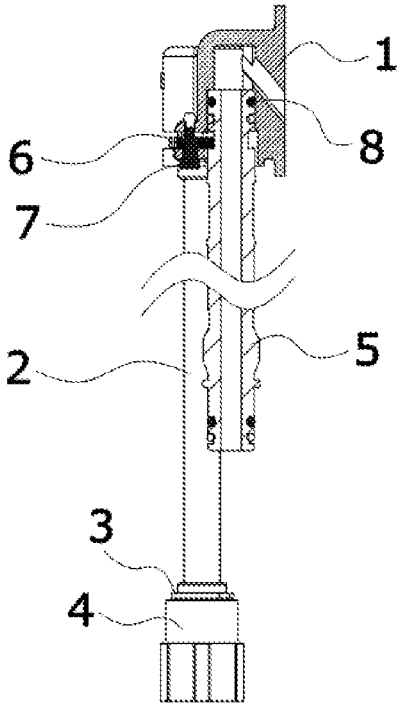
FIG. 5 is a second cross-sectional view of the embodiment of the present disclosure.
Figure 6:
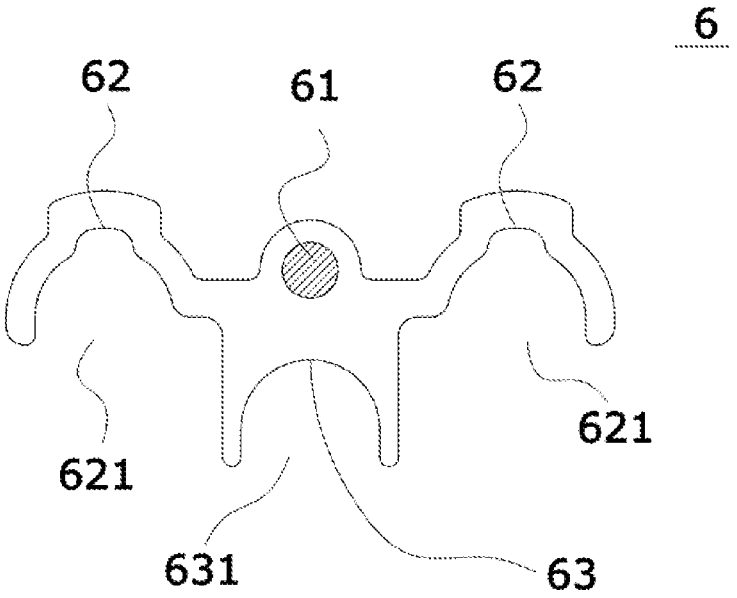
FIG. 6 is a front view of a gasket according to the embodiment of the present disclosure.
Figure 7:
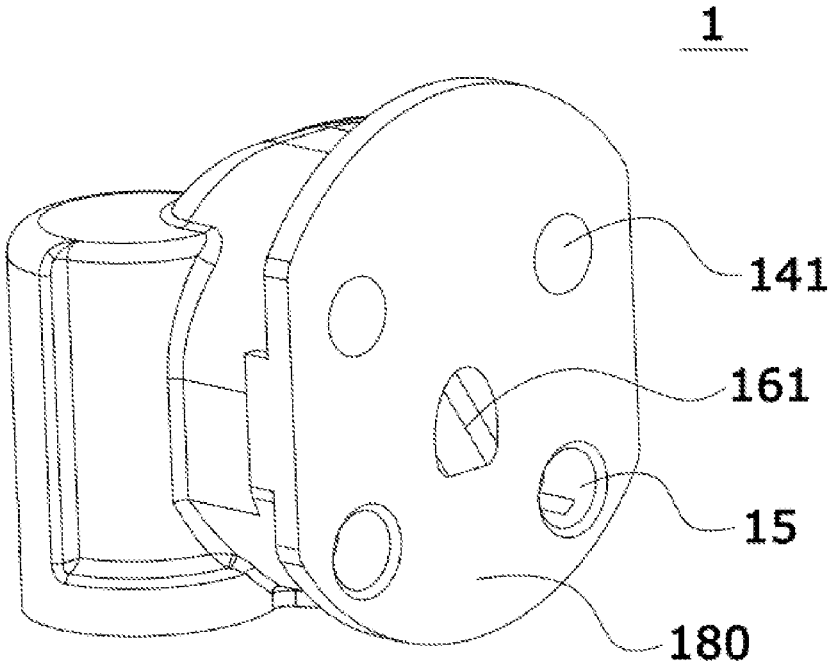
FIG. 7 is an isometric view of a body core according to the embodiment of the present disclosure.
Figure 8:
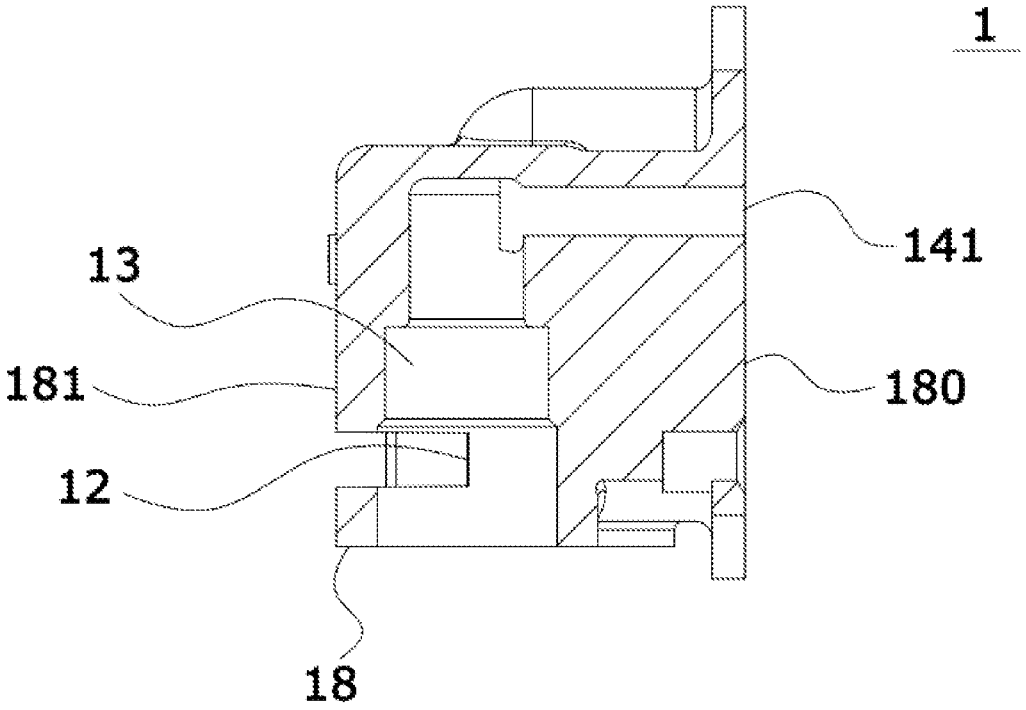
FIG. 8 is a first cross-sectional view of the body core according to the embodiment of the present disclosure.
Figure 9:
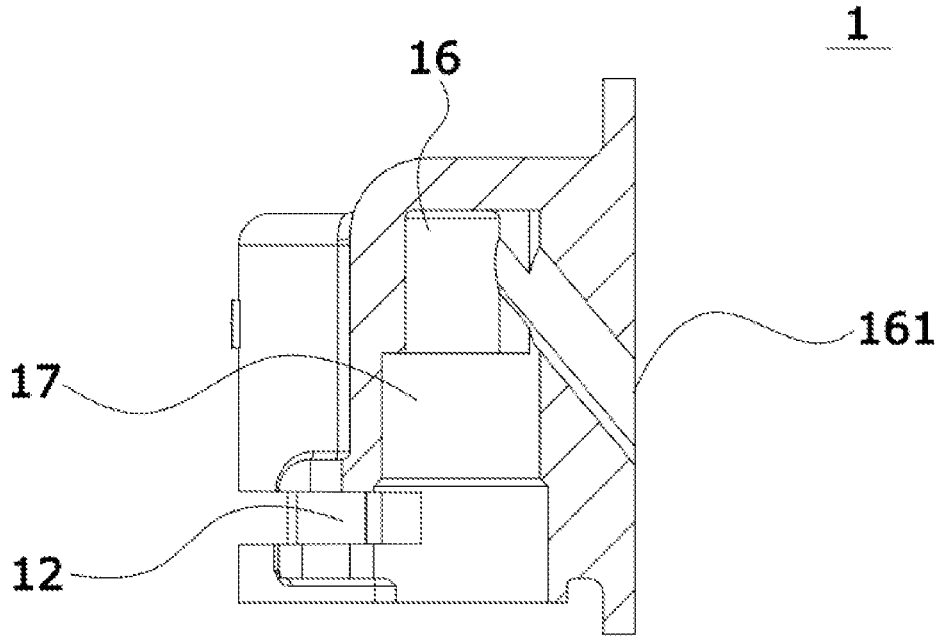
FIG. 9 is a second cross-sectional view of the body core according to the embodiment of the present disclosure.
Figure 10:
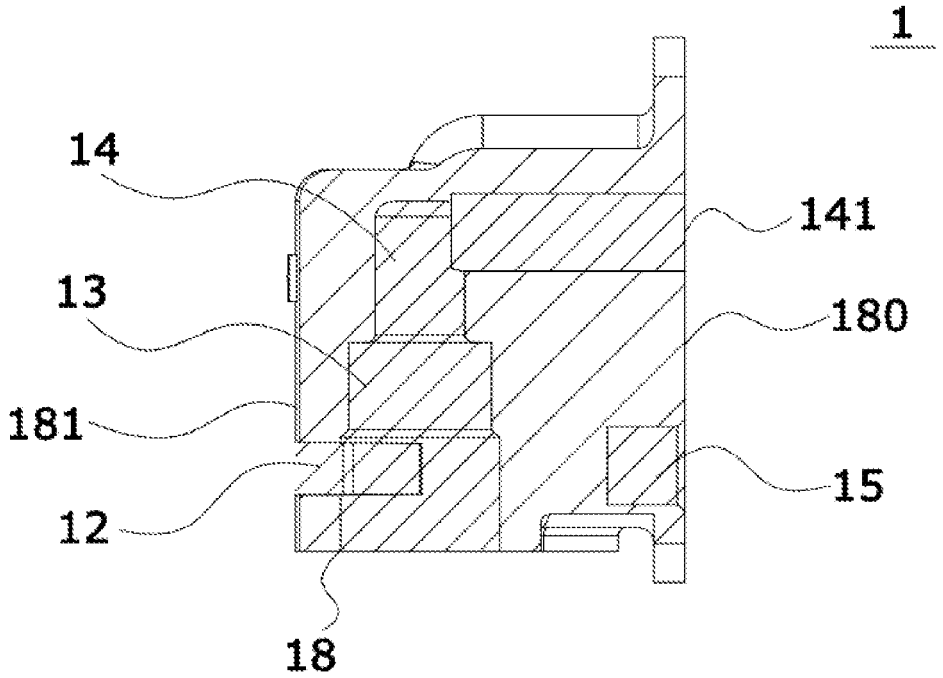
FIG. 10 is a third cross-sectional view of the body core according to the embodiment of the present disclosure.
Figure 11:
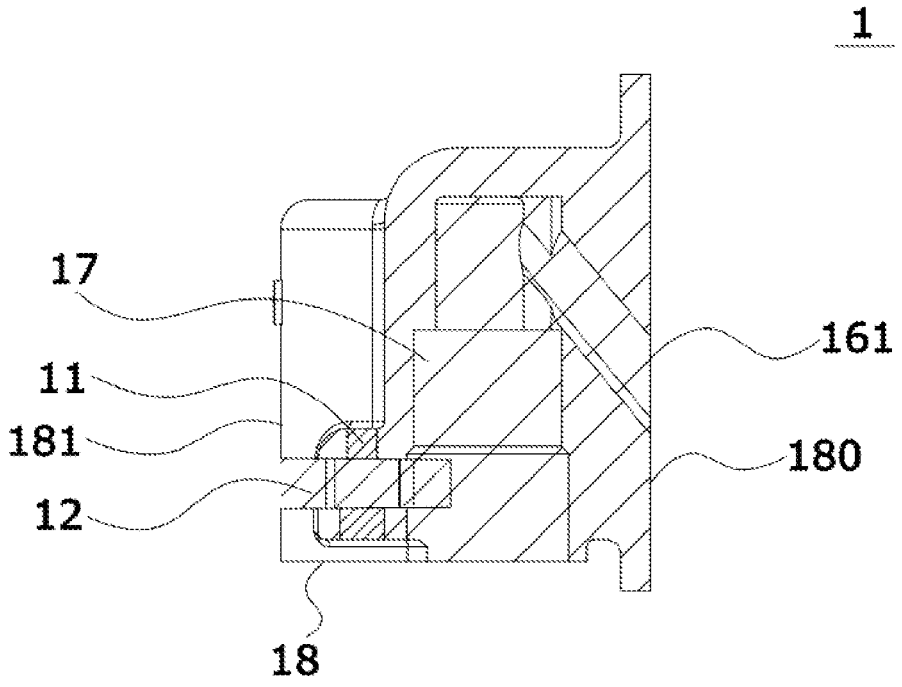
FIG. 11 is a fourth cross-sectional view of the body core according to the embodiment of the present disclosure.
Figure 12:
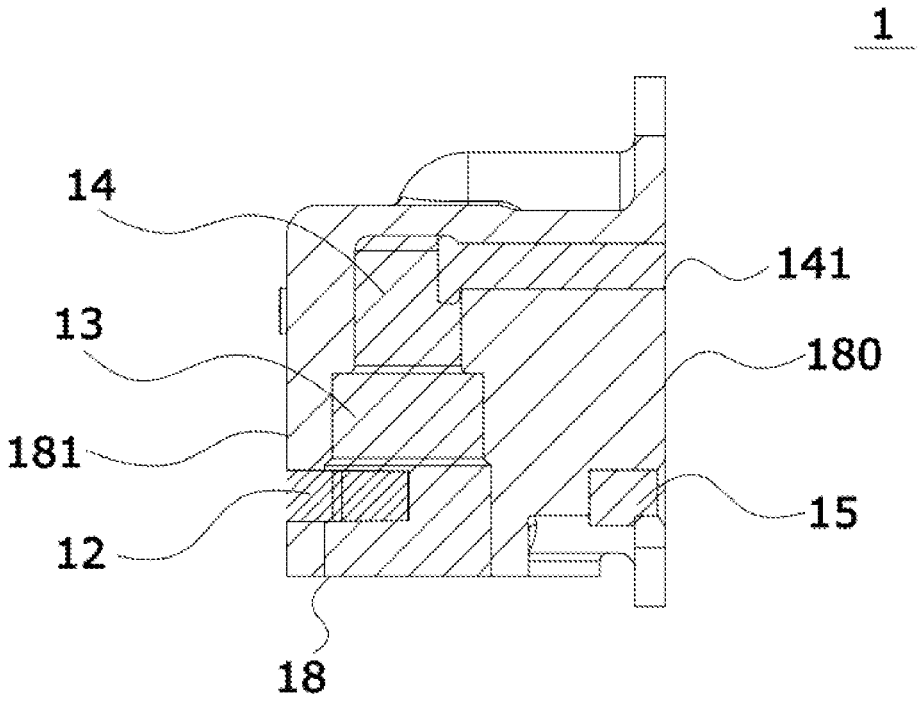
FIG. 12 is a fifth cross-sectional view of the body core according to the embodiment of the present disclosure.
Figure 13:
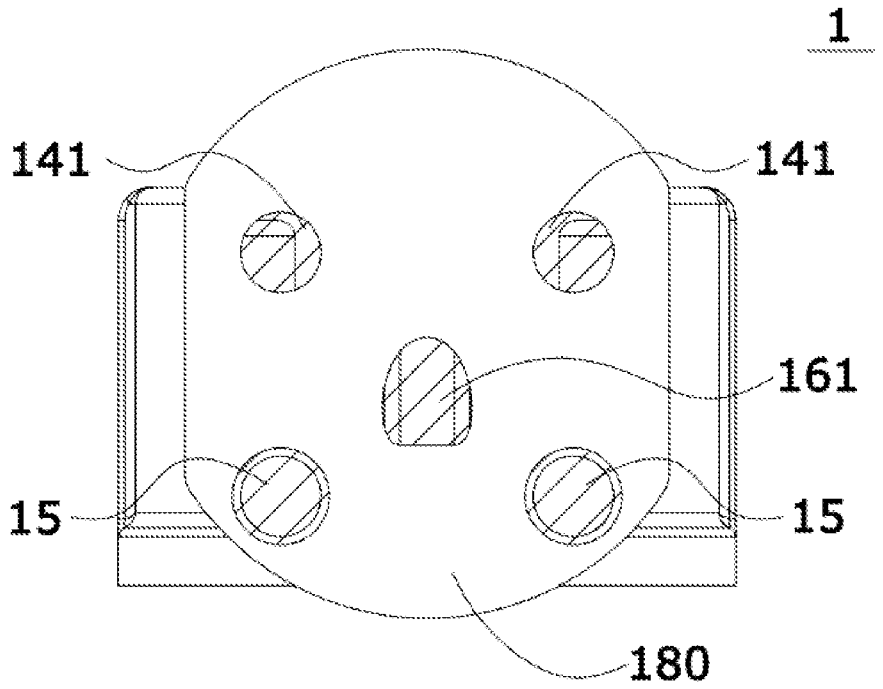
FIG. 13 is a front view of the body core according to the embodiment of the present disclosure.
Figure 14:
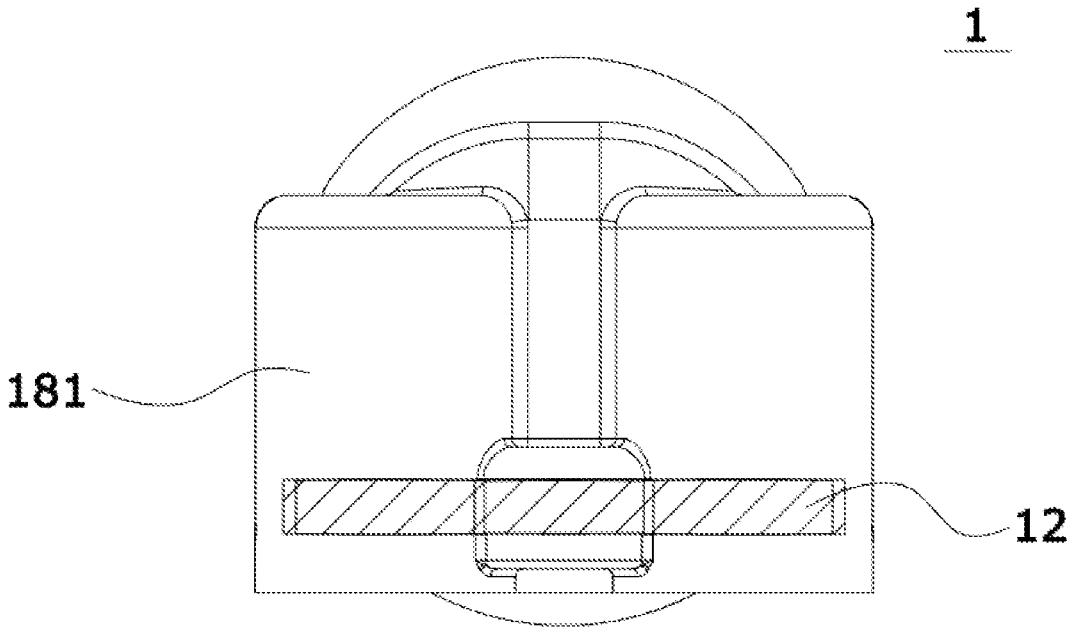
FIG. 14 is a first cross-sectional view from a rear view of the embodiment of the present disclosure.
Figure 15:
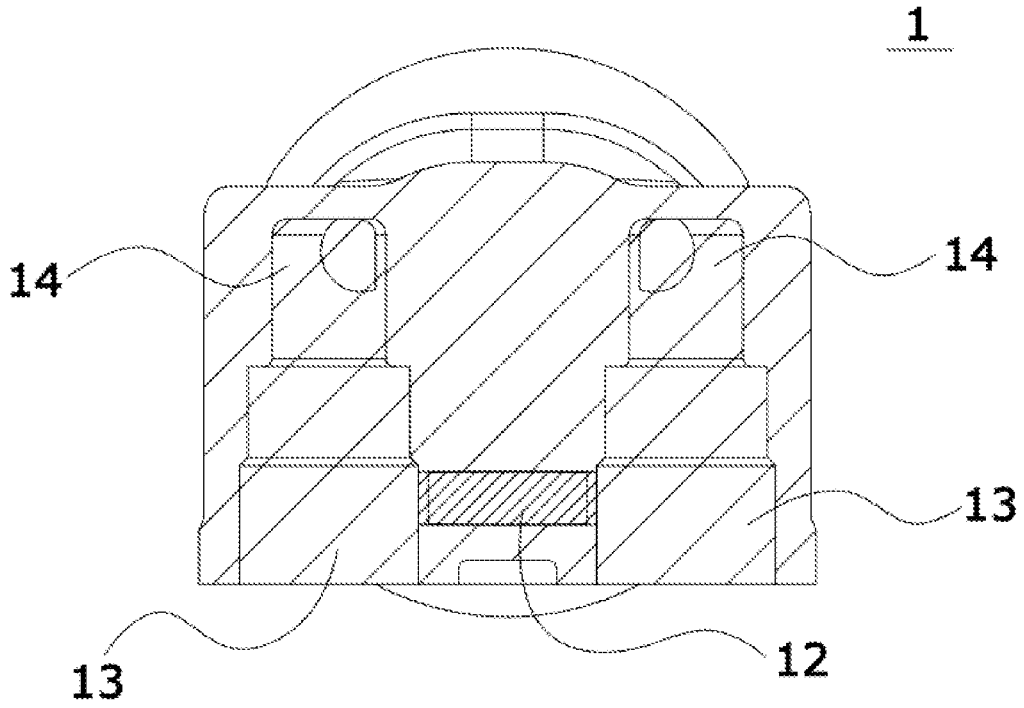
FIG. 15 is a second cross-sectional view from the rear view of the embodiment of the present disclosure.
Figure 19:
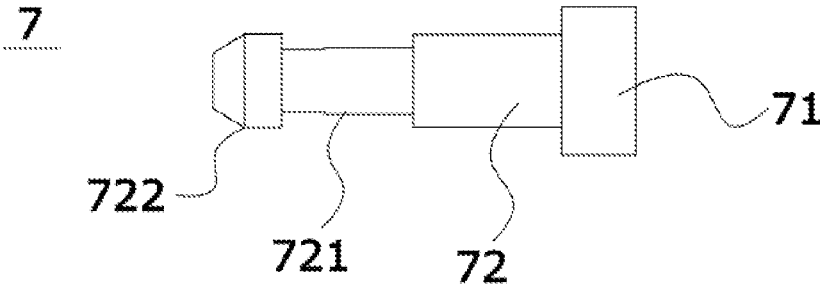
FIG. 19 is a front view of a pin according to the embodiment of the present disclosure.
Figure 22:
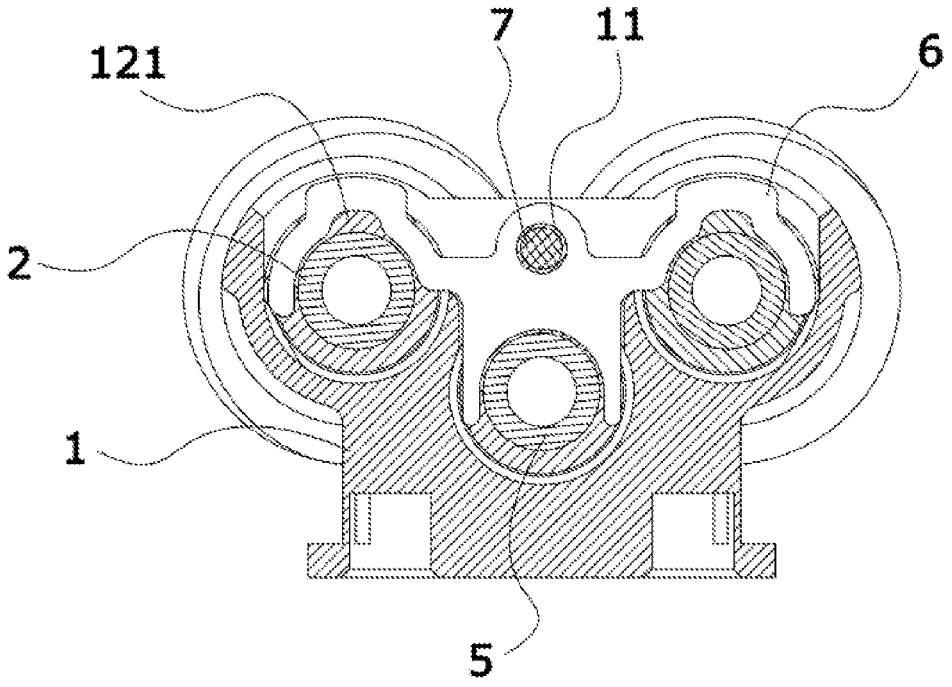
FIG. 22 is a first cross-sectional view under a state of the embodiment of the present disclosure.
Figure 23:
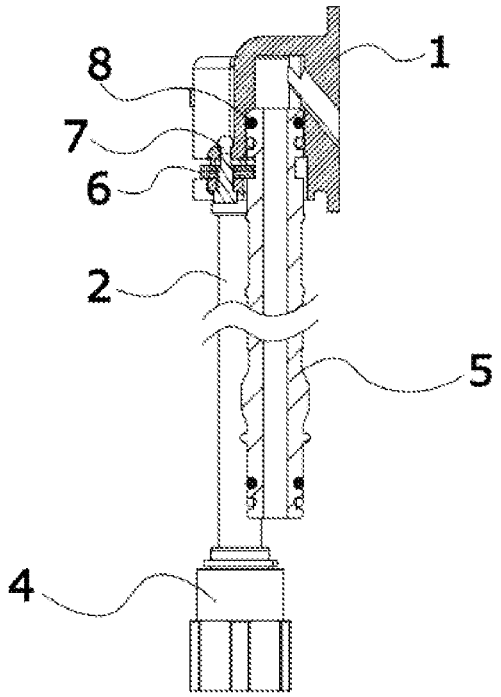
FIG. 23 is a second cross-sectional view under a state of the embodiment of the present disclosure.
Figure 24:
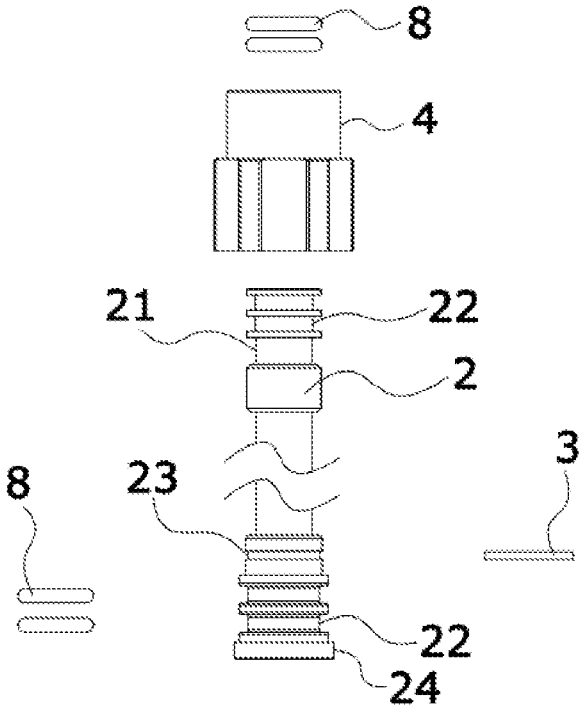
FIG. 24 is a second exploded view of the embodiment of the present disclosure.
Figure 25:
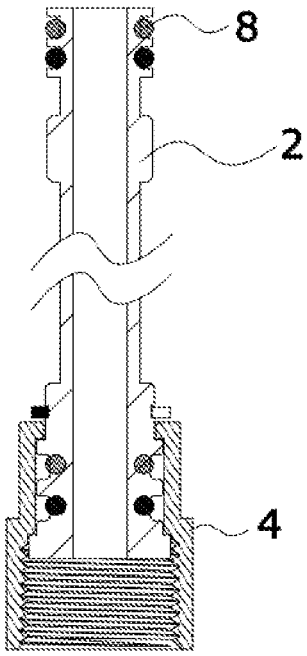
FIG. 25 is a third cross-sectional view of the embodiment of the present disclosure.
Figure 26:
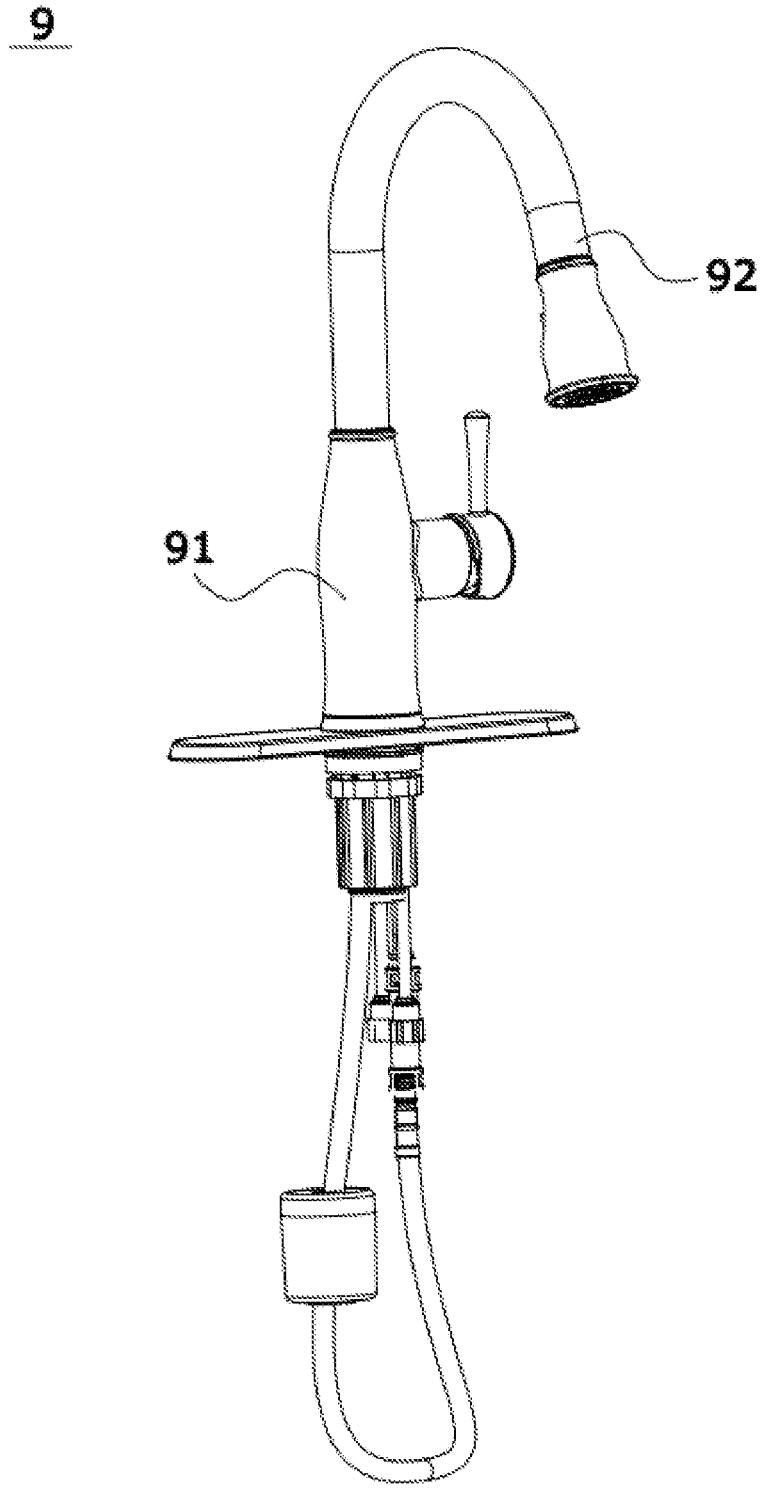
FIG. 26 is an isometric view showing the embodiment of the present disclosure applied in a faucet.

Referring to FIGS. 4 and 5, in order to ensure that the gasket 6 can tightly clamp the first water pipes 2 and the second water pipe 5, the gasket 6 includes the first pipe snap grooves 62 corresponding to the first water pipe holes 13, the second pipe snap groove 63 corresponding to the second water pipe hole 17, and the pin hole 61 corresponding to the pin groove 11. The first pipe snap grooves 62 and the second pipe snap groove 63 are respectively provided with an opening 631/621, and the openings 631/621 are arranged toward the side away from the pin hole 61. When the gasket 6 is inserted into the gasket insertion groove 12 and cannot be inserted deeper, as shown in FIG. 22, the peripheral wall of the first pipe snap grooves 62 is engaged with the first snap groove 21, and the peripheral wall of the second pipe snap groove 63 is engaged with the second snap groove 51. The first snap groove 21 and the first pipe snap groove 62 restrict each other, the second snap groove 51 and the second pipe snap groove 63 restrict each other, so that the first water pipes 2 and the second water pipe 5 are fastened in the body core 1. Referring to FIG. 19, the pin 7 includes a pin head 71 and a pin body 72 provided at one end of the pin head 71. The pin body 72 is provided with a recess 721 at an end away from the pin head 71. A step 722 is provided at one end of the recess 721 away from the pin head 71. When the pin 7 is inserted into the pin hole 61, as shown in FIGS. 11 and 20, the pin 7 is inserted from the pin groove 11 and passes through the pin hole 61 to be clamped by the pin hole 61, the recess 721 is placed in the pin hole 61, the step 722 is clamped at the bottom end of the pin groove 11, and the pin 7 restricts the gasket 6 to avoid the gasket 6 to come off from the back surface 181 of the body core 1.

Figure 27:
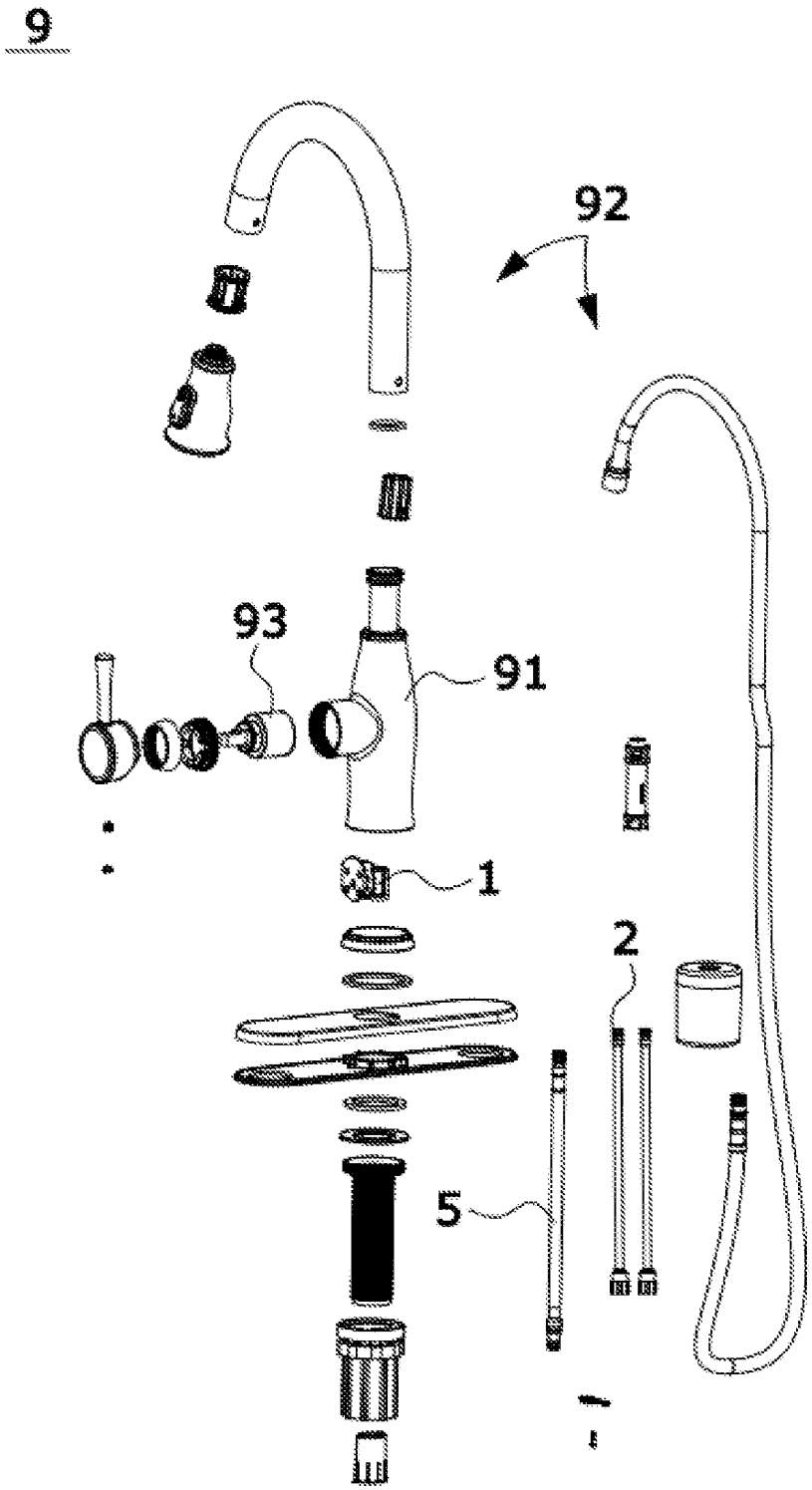
FIG. 27 is an exploded view showing the embodiment of the present disclosure applied in a faucet.

Referring to FIGS. 7 to 13, the front end surface 180 of the body core 1 is provided with two first water passage holes 141, a second water passage hole 161, and two positioning holes 15 at intervals. The two first water passage holes 141 are arranged side by side. The two positioning holes 15 are arranged side by side and are positioned away from the first water passage holes 141. The second water passage hole 161 is provided in the middle surrounded by the two first water passage holes 141 and the two positioning holes 15. The first water passage holes 141 and the first water pipe holes 13 communicate with each other through the first water passage holes 141, and the second water passage hole 161 and the second water pipe hole 17 communicate with each other through a second water passage 16. Referring to FIG. 27, the body core 1 is provided in the faucet body 91, a valve core 93 is installed in the faucet body 91 and is provided on the body core 1, the first water passage holes 141 and the second water passage hole 161 respectively correspond to the water inlet hole and the water outlet hole of the valve core 93, and the positioning feet of the valve core 93 are placed in the positioning holes 15 to prevent the valve core 93 from being displaced.

Figure 21:
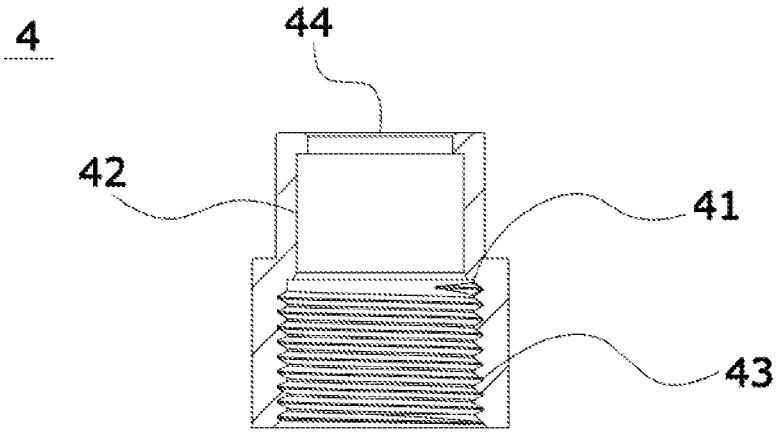
FIG. 21 is a cross-sectional view of a nut according to the embodiment of the present disclosure.

In this embodiment, the first water pipes 2 are water inlet pipes, and the first water pipes 2 are connected to an external water source. Therefore, the first water pipes 2 are connected to external components through the nut 4. Referring to FIGS. 3 and 4 and FIGS. 24 and 25, one end of the first water pipes 2 away from the body core 1 is connected to a nut 4. The end of the first water pipes 2 away from the body core 1 is respectively provided with a third snap groove 23, a sealing groove 22 and a limiting shoulder 24 arranged from the end close to the body core 1 to the end away from the body core 1. The sealing groove 22 is provided with a sealing ring 8. As shown in FIG. 21, the inner wall of the nut 4 is provided with a smooth section 42 and a threaded section 43. An end surface 41 is provided between the smooth section 42 and the threaded section 43. The smooth section 42 is provided close to one end of the body core 1, when the nut 4 is connected to the first water pipe 2, the limiting shoulder 24 is restricted to the end surface 41, and the sealing ring 8 is arranged in sealing cooperation with the smooth section 42. The third snap groove 23 passes through the nut 4 and is exposed outside the nut 4 to be connected to an snap ring 3. The snap ring 3 makes the nut 4 cannot fall off from the first water pipe 2. The threaded section 43 is connected to the outer component.

Figure 20:
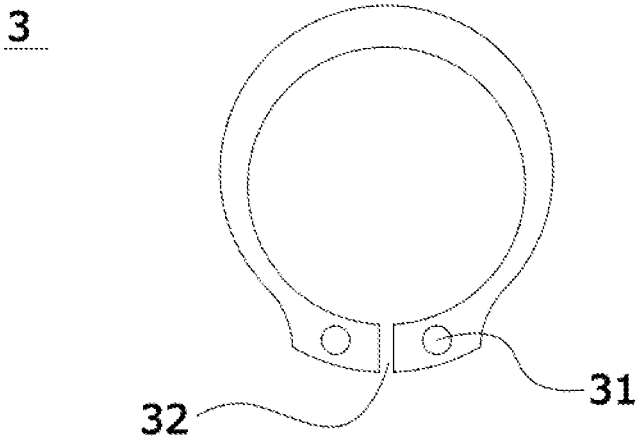
FIG. 20 is a front view of a snap ring according to the embodiment of the present disclosure.

Referring to FIG. 20, the snap ring 3 has an opening 32, and both sides of the opening 32 are each provided with an engagement point 31. Put the snap ring 3 inside until the upper end of the nut 4, and use a snap ring pliers to fit in the engagement points 31 to spread the snap ring 3 to expand the opening 32, and the snap ring 3 is clamped into the third snap groove 23, so that the nut 4 is limited on the first water pipe 2. The nut 4 is rotatable relative to the smooth section 42 so that the outer component can be rotatably connected to the first water pipe 2.

The following description discusses the assembly process of the present disclosure: insert the first water pipes 2 and the second water pipe 5 into the body core 1 all the way to the bottom, meanwhile align the first snap grooves 21 and the second snap groove 51 with the gasket insertion groove 12; insert the gasket 6 toward the front end surface 180 of the body core 1 along the direction of the gasket insertion groove 12 until it cannot be inserted deeper anymore, refer to FIG. 22, after the gasket 6 is inserted, the first pipe snap grooves 62 and the second pipe snap groove 63 half surround the first water pipes 2 and the second water pipe 5, and the gasket 6 can make the body core 1 contact with the end surfaces of the first snap grooves 21 and the second snap groove 51; insert the pin 7 into the pin groove 11 and the pin groove 11 along the water inlet direction, after the pin 7 is inserted in place, the two end surfaces of the recess 721 of the pin 7 are respectively attached flat with the two end surfaces of the pin groove 11 of the body core 1, with the mutual interaction, the step 722 of the pin 7 is tightly fitted with the body core 1. The pin 7 fixes the gasket 6, the first water pipes 2, the second water pipe 5 and the body core 1 and locks them in place, so that the first water pipes 2 and the second water pipe 5 cannot fall off, and the pin 7 cannot fall off as well. After the sealing ring 8 is inserted into the sealing groove 22, put the nut 4 vertically from the opening of the first water pipe 2, make the end surface of the nut 4 fitted and attached with the end surface of the limiting shoulder 24 of the first water pipe 2 to limit the nut 4. Put the snap ring 3 inside to the upper end surface 44 of the nut 4, and fit the snap ring pliers into the engagement points 31, spread the snap ring to expand the opening 32, so the snap ring 3 is engaged into the third snap groove 23. At this point, the two ends of the first water pipes 2 and the second water pipe 5 are assembled with the body core 1.

The above descriptions are only preferred embodiments of the present disclosure and are not intended to limit the present disclosure. For those of ordinary skill in the art, the present disclosure may have various modifications and changes. Any modifications, equivalent substitutions, improvements, etc. made within the spirit and principles of the present disclosure shall be considered as falling within the protection scope of the present disclosure.

What is claimed is:

1. An installation structure for a body core with rotatable flexible pipe, comprising:

a first water pipe and a second water pipe, wherein the first water pipe includes snap grooves and sealing rings that are sequentially provided at both ends of the first water pipe, the second water pipe includes a snap groove and a sealing ring that are sequentially provided at an outlet end of the second water pipe, and the snap grooves of both the first water pipe and the second water pipe are provided at a side proximal to a middle part of the water pipes, respectively;

wherein, the body core comprises at least two pipe holes and a gasket insertion groove perpendicular to and communicating with the pipe holes, the gasket insertion groove corresponds to the snap grooves of both the first water pipe and the second water pipe, and the first water pipe and the second water pipe are inserted into the pipe holes, a gasket is inserted into the gasket insertion groove and is engaged with the snap grooves of both the first water pipe and the second water pipe; and a nut, wherein the nut comprises a non-threaded section and an end surface located next to the non-threaded section, the first water pipe passes through the nut and is restricted by the end surface, the snap groove of the first water pipe at an end distal to the body core passes through the nut and is exposed from an upper end surface of the nut, a snap ring is inserted into the snap groove of the first water pipe at the end distal to the body core, so that the first water pipe and the nut are rotatably connected to the body core.

2. The installation structure according to claim 1, wherein a bottom end surface of the body core is provided with a pin groove extending upward, and the gasket is provided with a pin hole corresponding to the pin groove, and a pin is inserted into the pin groove and the pin passes through the pin hole to be engaged with the gasket.

3. The installation structure according to claim 1, wherein two first water pipes and one second water pipe are provided, both ends of each of the first water pipes are respectively provided with a first snap groove and a third snap groove, and first sealing grooves are respectively provided at a side of the first snap groove and the third snap groove away from the middle part of the first water pipe; the end of the second water pipe is provided with a second snap groove and a second sealing groove, and the second sealing groove is located at a side of the middle part of the second water pipe, each of the first sealing groove and second sealing groove is provided with one sealing ring.

4. The installation structure according to claim 3, wherein the bottom end surface of the body core is provided with two first water pipe holes and a second water pipe hole extending upward, the two first water pipe holes are arranged side by side, and the second water pipe hole is provided between the two first water pipe holes and is staggered with the two first water pipe holes; the two first water pipes and the second water pipe are respectively inserted into the first water pipe holes and the second water pipe hole, the sealing rings on the first water pipes and the second water pipe are sealingly matched with side wall surfaces of the first water pipe holes and the second water pipe hole.

5. The installation structure according to claim 3, wherein a back surface of the body core is transversely provided with the gasket insertion groove extending toward a front end surface of the body core, and the gasket insertion groove communicates with the first water pipe holes and the second water pipe hole, the gasket is inserted into the gasket insertion groove and is engaged with the first snap grooves and the second snap groove.

6. The installation structure according to claim 3, wherein a front end surface of the body core is provided with two first water passage holes, a second water passage hole, and two positioning holes spaced apart from each other, the two first water passage holes are arranged side by side, and the two positioning holes are arranged side by side and are arranged away from the first water passage holes, and the second water passage hole is provided in a middle position surrounded by the two first water passage holes and the two positioning holes, the first water passage holes communicate with the first water pipe holes through a first water passage, the second water passage hole communicates with the second water pipe hole through a second water passage.

7. The installation structure according to claim 3, wherein an inner wall of the nut is provided with the non-threaded section and a threaded section, and the end surface is provided between the non-threaded section and the threaded section; the first water pipes are each provided with a limiting shoulder at a side distal to the body core, and the limiting shoulder is located at a side away from the middle of the first water pipes; when the nut is connected to the first water pipes, the limiting shoulder is limited to the end surface, the sealing ring is sealingly matched with the non-threaded section.

8. The installation structure according to claim 7, wherein the snap ring has an opening, and both sides of the opening are respectively provided with an engagement point.

9. The installation structure according to claim 2, wherein the gasket comprises two first pipe snap grooves and a second pipe snap groove, the two first pipe snap grooves are arranged side by side, and the second pipe snap groove is provided on a first side of the first pipe snap grooves and is placed in the middle of the two first pipe snap grooves, and the pin hole is located on a second side of the first pipe snap grooves and corresponds to the second pipe snap groove; the first pipe snap grooves and the second pipe snap groove are each provided with an opening, and the openings are arranged toward a same side away from the pin hole.

10. The installation structure according to claim 2, wherein the pin comprises a pin head and a pin body provided at an end of the pin head, the pin body is provided with a recess at an end away from the pin head, and the recess is provided with a step at the end away from the pin head, the pin is inserted into the pin groove and passes through the pin hole to be engaged with the pin hole, the recess is located in the pin hole, and the step is restricted to a bottom end of the pin groove.

* * * * *